US010329000B1

(12) United States Patent
Foust

(10) Patent No.: US 10,329,000 B1
(45) Date of Patent: Jun. 25, 2019

(54) ROLLABLE MAT

(71) Applicant: Steven B. Foust, Mound, MN (US)

(72) Inventor: Steven B. Foust, Mound, MN (US)

( * ) Notice: Subject to any disclaimer, the term of this patent is extended or adjusted under 35 U.S.C. 154(b) by 0 days.

(21) Appl. No.: 15/694,428

(22) Filed: Sep. 1, 2017

Related U.S. Application Data

(60) Provisional application No. 62/383,298, filed on Sep. 2, 2016.

(51) Int. Cl.
*B63B 35/74* (2006.01)
*B63B 35/73* (2006.01)
*B63B 59/02* (2006.01)

(52) U.S. Cl.
CPC ..... *B63B 35/73* (2013.01); *B63B 59/02* (2013.01); *B63B 35/74* (2013.01); *B63B 2035/735* (2013.01)

(58) Field of Classification Search
CPC ..... A63B 21/4037; B63B 35/74; B63B 35/76; B63B 35/78; B60J 11/02; B60J 11/025
See application file for complete search history.

(56) References Cited

U.S. PATENT DOCUMENTS 4,324,370 A * 4/1982 Guard ..... E04H 4/101 242/403
9,932,092 B1 * 4/2018 Garruto ..... B63B 17/02

* cited by examiner

*Primary Examiner* — Andrew Polay
(74) *Attorney, Agent, or Firm* — Richard John Bartz

(57) ABSTRACT

A mat and apparatus for rolling the mat adapted to be releasably affixed to a vehicle whereby the mat may be unrolled for use and easily rolled up for storage from within the vehicle and removed from the vehicle for additional uses. The mat and apparatus for rolling the mat is attachable to the back of the vehicle or a side thereof as desired.

1 Claim, 10 Drawing Sheets

ROLLABLE MAT

RELATED APPLICATION

This application claims the priority benefit of U.S. Provisional Patent Application Ser. No. 62/383,298 filed Sep. 2, 2016.

FIELD OF THE INVENTION

This disclosure relates generally to a releasable system for mounting and storing a flexible member for use as a recreational device and protection for a vehicle with a easy and lightweight mechanism for anchoring a flexible sheet to a vehicle and storing the flexible sheet.

BACKGROUND OF THE INVENTION

Watercraft are exposed to a unique combination of forces which make mounting and efficient storage of all items in the vehicle essential to its use. The vehicle is designed move at high speeds while being buffeted wind and water. Additionally, space is at a premium for the efficient use of the vehicle. Mounting an object on a surface of the vehicle, particularly an object subject to high forces in use, requires balancing the need for sturdiness of the object with the physical limitations of the mounting surface. It is common knowledge within the art to permanently affix objects to the inner hull of the vehicle.

It has become a growing trend to provide multifunctional utility for a wide range of products designed for use in the water. As such, equipment becomes more ubiquitous and deployable from many different platforms. The largest limitation for use of these types of equipment is the use of stowage space. Therefore, it is an object of this invention to provide a mat while using the least amount of storage space in the vehicle. A flexible mat has numerous ways to restrict the amount of space it requires for storage. However, rolling the mat has the additional advantage of being easily repeatable and requiring little effort to duplicate the action required for storage.

Another growing trend in the use of water equipment is the need to mount the mat on the vehicle. Mounting the device allows for additional safety while the vehicle is in motion and reducing the need for maintenance. In addition, boats require an intermediary such as a bumper or fender to reduce the incidence of damage from contact with docks, boats, or other structures.

Other objects, features, and advantages of the mounting system will be explained in the following detailed description having reference to the appended drawings.

SUMMARY OF THE INVENTION

It is an object of this invention to overcome or ameliorate at least one of the disadvantages of the prior art, or to provide a useful alternative.

It is an object of the invention to provide a means for mounting a mat on a vehicle such that the mat is secure during operation and transportation. The mounting must provide reliable security from forces applied to the mounting during transportation and use.

It is another object of the invention to provide a releasing mechanism for all of the members of the invention. The attachment assembly may be able to allow a user to remove the fasteners from the mat, and thereby remove the mat from the sleeve. The sleeve may be removed from the center tube and the center tube may be removed from the brackets. The handle may be removed from the center tube or the sleeve.

It is another object of the invention to provide a quick and easy means for storage of the mat in the vehicle. The brackets and mounting assembly may facilitate the rolling of the mat. The mat may be manipulated by the use of the straps for quick and easy storage. The mat may be strategically placed in order to provide a buffer between the boat and any other structures which may come in contact with the boat, equipment which may be secured to the boat. The straps may be used to secure other equipment to the boat.

In another embodiment, the mounting is secured to the vehicle using tackifiers or other adhesives. Alternatively, the mounting may be secured using attaching members with a threaded nut and bolt assembly. Alternatively, the mat may be secured by tying the straps directly to the boat.

In another embodiment, straps are secured to the mat to facilitate rolling the mat before anchoring the mat to the vehicle. The rollable mat may be used by securing the straps to the securing assembly omitting the center tube and brackets entirely.

DETAILED DESCRIPTION OF THE INVENTION

In the following detailed description, reference is made to the accompanying illustrations and experimental data, which form a part hereof, and in which are shown, by way of illustration, specific embodiments in which the methods and systems described herein may be practiced. These embodiments are described in sufficient detail to enable those skilled in the art to practice the described systems and methods, and it is to be understood that the embodiments may be combined or used separately, or that other embodiments may be used, and that design, implementation, and procedural changes may be made without departing from the spirit and scope of the methods and systems described herein.

Figure 1:
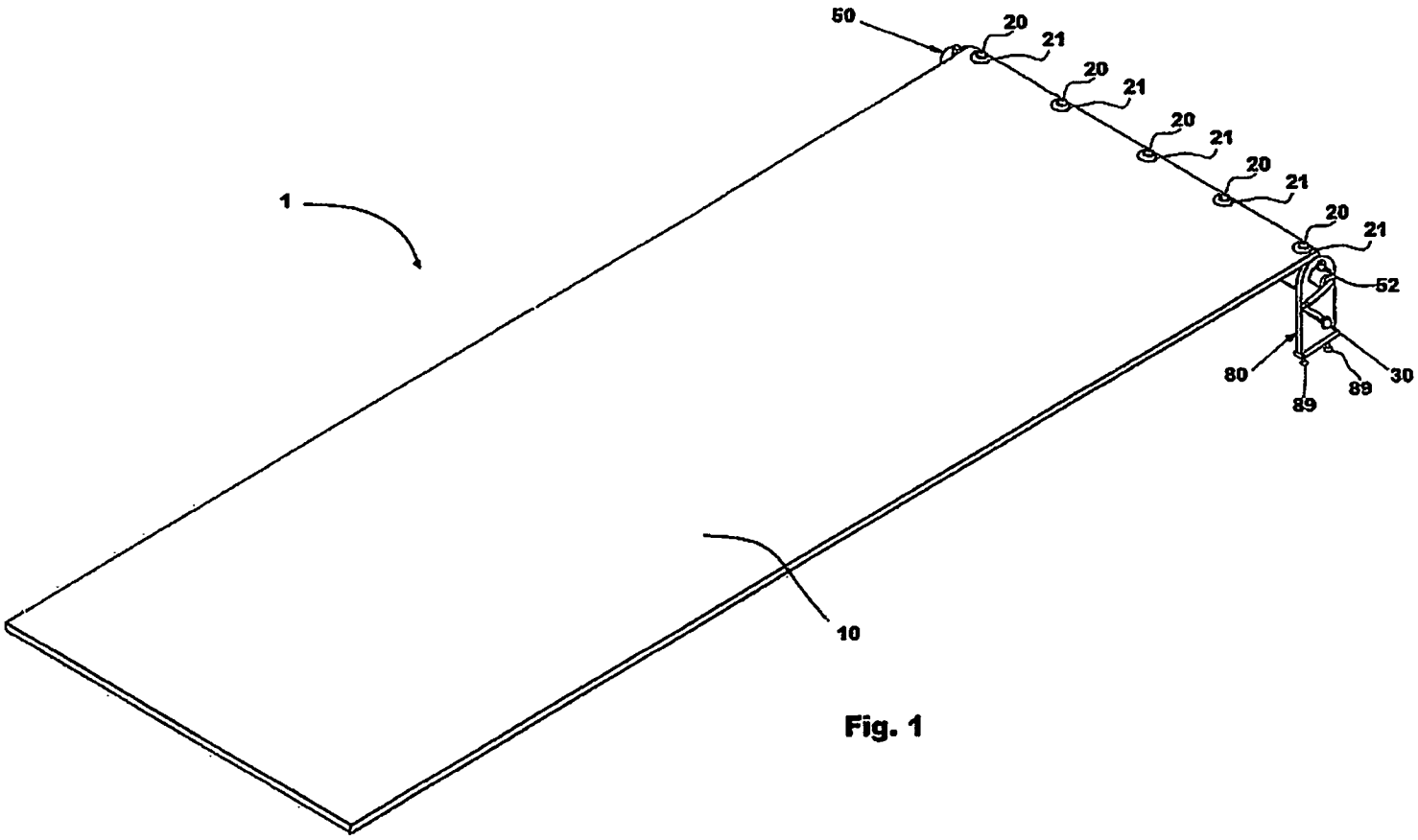
FIG. 1 illustrates an elevated planar view of a rollable mat showing the mat in an unrolled position and attached to the mounting mechanism.

FIG. 1 is illustrative of an embodiment of a rollable mat assembly 1. A mat 10 preferably made of cell foam or foam rubber materials of rectangular shape is releasably affixed to sleeve 51 by pressure from fastener 20 to sleeve 51. In some embodiments multiple pieces of foam material may be used. Examples of materials include, but are not limited to, polyethylene and ethylene vinyl acetate. These materials are generally lightweight and permanently buoyant. Washer 21 is placed between fastener 20 and mat 10 to provide additional surface area to apply downward pressure from fastener 20. A plurality of fastener 20 and washer 21 structures may be placed along the contact surface of mat 10 where mat 10 attaches to sleeve 51. Sleeve 51 is shaped such that sleeve 51 fits around center tube 50 when center tube 50 is slid inside sleeve 51. Center tube 50 must be allowed to rotate within sleeve 51 in order to transfer the rotational force necessary to wind mat 10 around sleeve 51. Center tube 50 includes releasable protrusions 52 such that releasable protrusions 52 prevent center tube 50 from sliding out of sleeve 51. Releasable protrusions 52 may be attached to center tube 50 via screw threading and corresponding threaded hole in center tube 50 or any tackifier or other adhesive material. Handle 30 is releasably attached to sleeve 51 such that handle 30 may remain affixed relative to sleeve 51. Handle 30 may be able to rotate relative to center tube 50 if a user provides the force necessary to rotate sleeve 51 around center tube 50. Handle 30 includes an user interface such that a user may hold the user interface in position, and the user interface will rotate relative to handle 30 when used to provide a fixed location for a user's hand relative to the rotation of handle 30.

Alternatively, handle 30 may be releasably attached to center tube 50 such that center tube 50 is affixed relative to sleeve 51. Under this alternative embodiment, center tube 50 and sleeve 51 are affixed such that center tube 50 and sleeve 51 do not move relative to each other, and the entire assembly of sleeve 51 and center tube 50 is mounted to bracket 80 and bracket 81 such that sleeve 51 and center tube 50 may rotate relative to bracket 81 and bracket 80.

In either embodiment center tube 50 must be mounted to a vehicle using bracket 80 and bracket 81 located at each end of center tube 50 in order to guide and otherwise facilitate the movement of mat 10 during rolling. In the preferred embodiment, bracket 80 and bracket 81 are positioned along center tube 50 such that brackets 80 and 81 are substantially the same distance from each other along center tube 50 as the width of mat 10 in order to facilitate a uniform rolling of mat 10.

Figure 2:
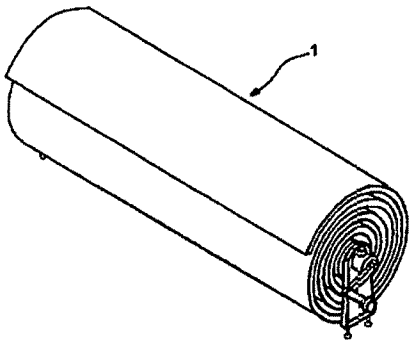
FIG. 2 illustrates an elevated planar view of the rollable mat of FIG. 1 showing the mat in an rolled position and attached to the mounting mechanism.

FIG. 2 illustrates rollable mat assembly 1 in storage position where mat 10 is wound around center tube 50. Bracket 80 and bracket 81 provide enough height to allow mat 10 to roll without interference from the vehicle where releasable mat and roller assembly 1 is affixed to a vehicle.

Figure 3:
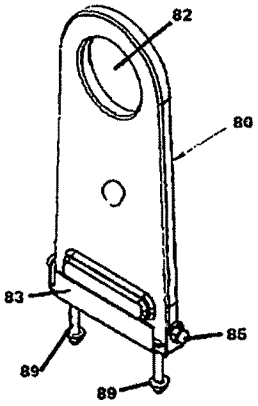
FIG. 3 illustrates an elevated planar view of a bracket and mounting assembly in an upright position.

FIG. 3 is illustrative of an embodiment of bracket 80 in an upright position. Bracket 80 includes cutout 82 such that cutout 82 supports and facilitates the rotation of a center tube described elsewhere in this embodiment. Bracket 80 includes hinge 85 such that when bracket 80 is affixed to a vehicle, bracket 80 may be rotated such that bracket 80 sits flush to the surface of the vehicle. Bracket 80 includes attaching members 89 such that bracket 80 may be anchored to a vehicle in order to prevent movement of bracket 80 together with mounting plate 83 during use of the vehicle. Mounting plate 83 accommodates hinge 85 and attaching members 89 such that bracket 80 may remain fixably attached to a vehicle while rotating to sit flush with the vehicle while not in use.

Figure 4:
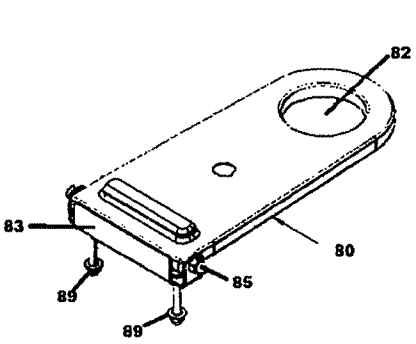
FIG. 4 illustrates an elevated planar view of a bracket and mounting assembly in a folded position.

FIG. 4 is an illustrative embodiment of bracket 80 sitting in a flush position relative to the vehicle. The mounting assembly for bracket 80 includes cutout 82, hinge 85, attaching members 89 and mounting plate 83. Mounting plate 83 includes side walls in order to facilitate each member 89 is not restricted to a single plane.

Figure 5:
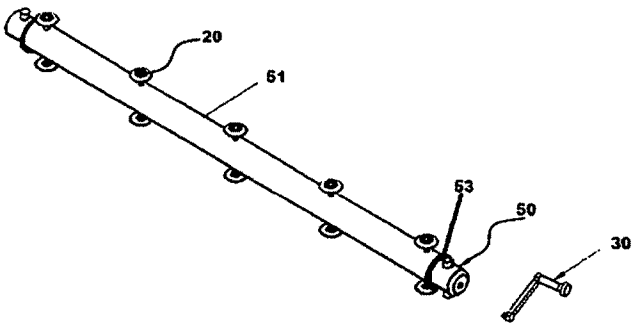
FIG. 5 illustrates an elevated planar view of a center tube and sleeve assembly with a diagram of a handle.

FIG. 5 is an illustrative embodiment of sleeve 51 and center tube 50 assembly and includes a diagram of handle 30. Sleeve 51 includes a plurality of fasteners 20 with washer 21 such that the forces acting on mat 10 are distributed evenly along the length of sleeve 51. Sleeve 51 includes bearing 53 to reduce friction between sleeve 51 and center tube 50.

Figure 6:
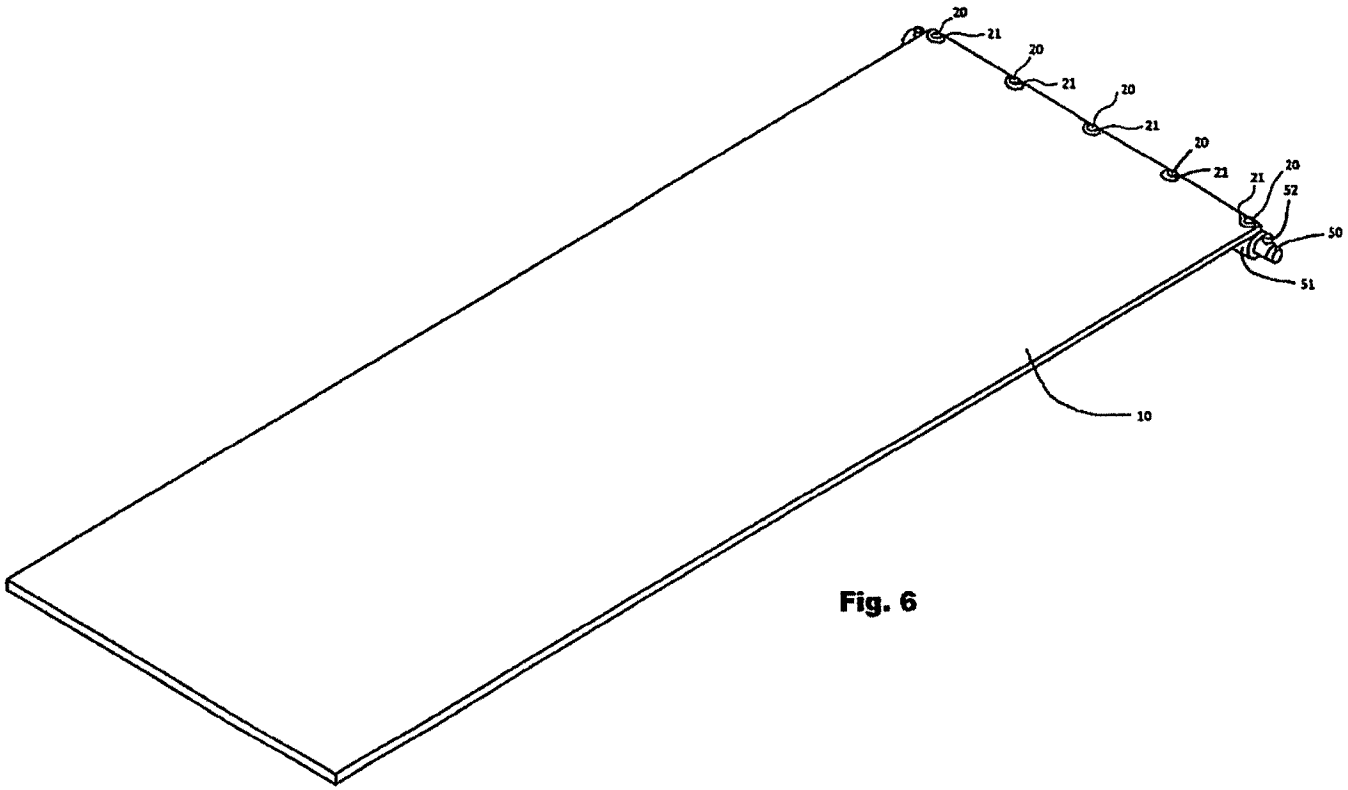
FIG. 6 illustrates an elevated planar view of a mat attached to a center tube and sleeve assembly.
Figure 7:
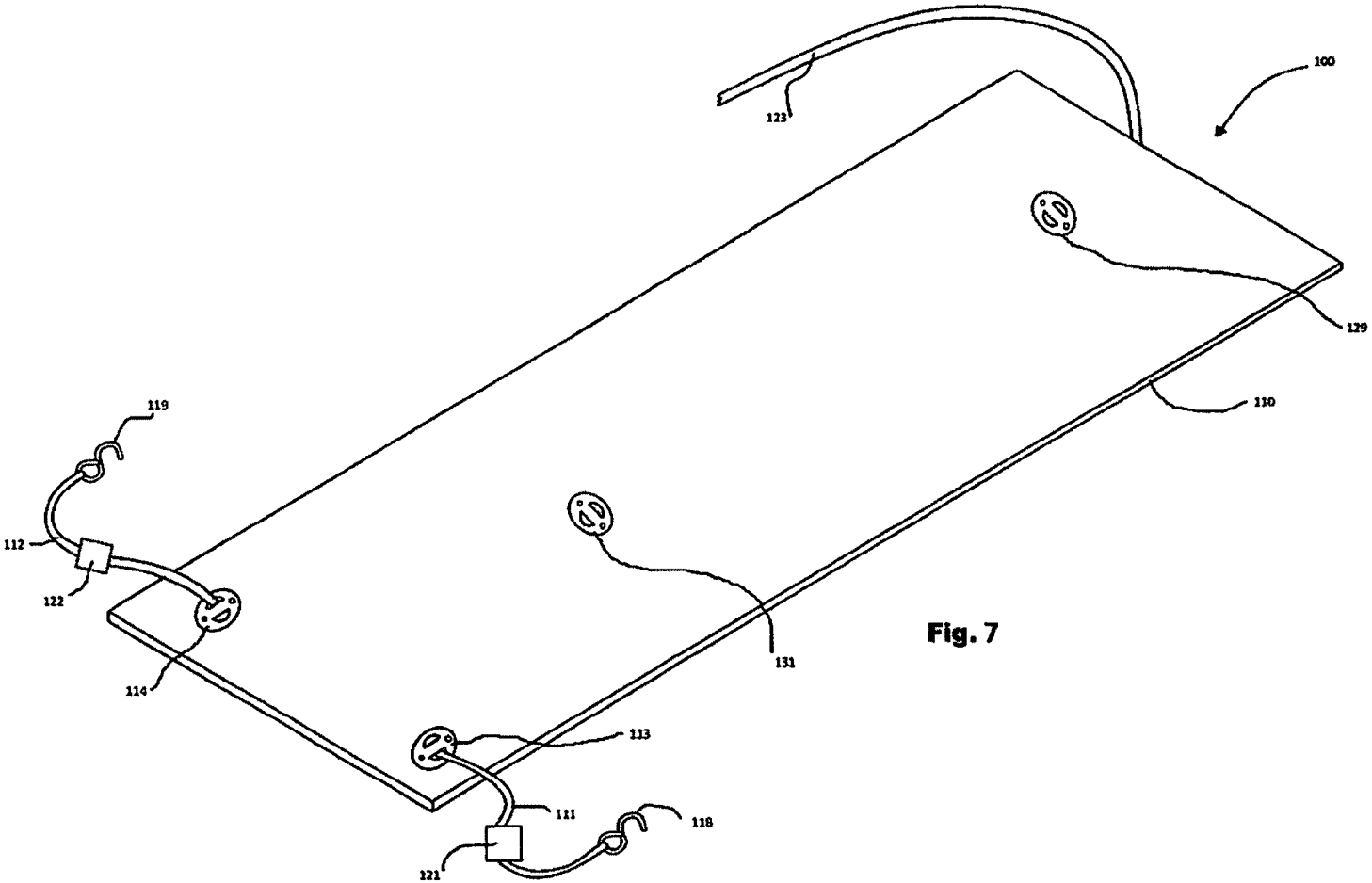
FIG. 7 illustrates a modification of the rollable mat showing the mat in an unrolled position.
Figure 8:
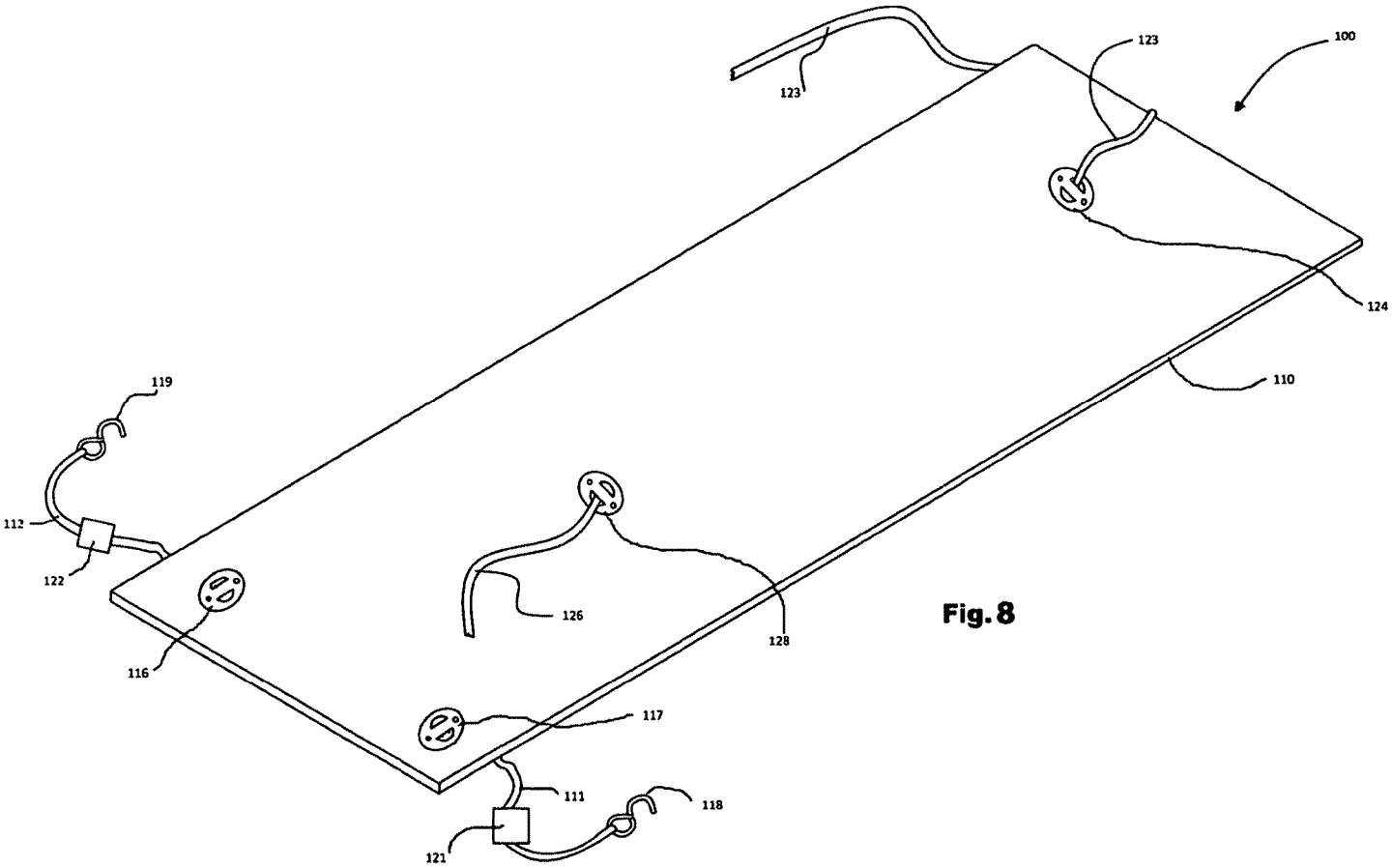
FIG. 8 illustrates a bottom view of the rollable mat of FIG. 7.
Figure 9:
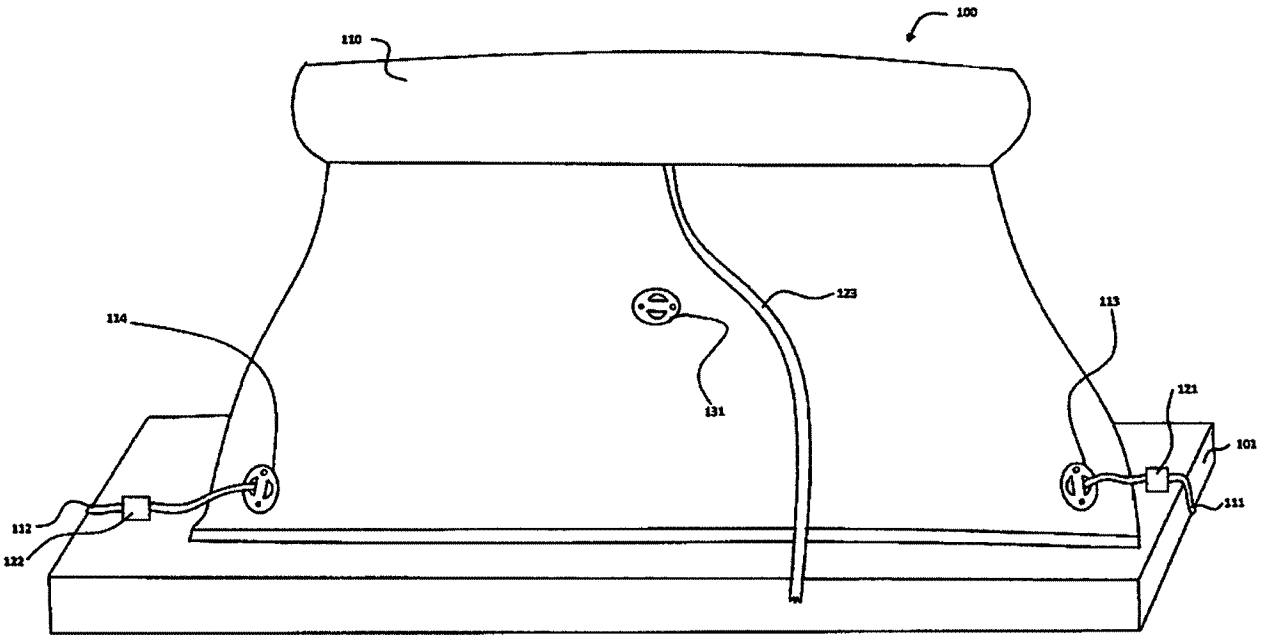
FIG. 9 illustrates an elevated planar view of the rollable mat of FIG. 7 showing the mat attached to a watercraft.

FIG. 6 is illustrative of an embodiment of a first modification of rollable mat assembly 1. In this embodiment, a mat 10 is releasably attached to sleeve 51 using a plurality of fasteners 20 and washers 21. Sleeve 51 is in slidable engagement with center tube 50 and is held in place by releasable protrusions 52.

A second modification of rollable mat assembly 100, shown in FIGS. 7 to 11, is adapted to be affixed to a watercraft 101 and used as an anchored flotation water toy. Apparatus 100 is attachable to the back of watercraft 101 or to a side of the watercraft 101 as desired. Apparatus 100 has a floatable water mat 110 of rectangular shape releasable affixed to watercraft 101 with straps 111 and 112. Straps 111 and 112 are secured to clips 113 and 114 located on the front side of mat 110 on opposite corners of the inner end of mat 110. Clips 116 and 117 are located on the back side of mat 110 opposite from clips 113 and 114 to facilitate assembly and allow the front and back sides of mat 110 to be interchangeable. Clips 113, 114, 116 and 117 are preferably D-ring clips having flush mount plates fastened to mat 110. Other types of clips or securing members attached to mat 110 can be used to accommodate straps 111 and 112.

The outer ends of straps 111 and 112 are affixed to hook members 118 and 119. Hook members 118 and 119 are adapted to hook structure of watercraft 101 to releasably attach the inner end of mat 110 to watercraft 101. Hook members 118 and 119 are preferably S-hooks having an open end adapted to engage and hook onto watercraft structure and hardware. Other types of hook members, such as carabiner-style clips, can be used to attach straps 111 and 112 to watercraft structure and hardware. Alternatively, straps 111 and 112 may be tied directly to the watercraft.

Slack adjusting members 121 and 122 mounted on straps 111 and 112 allow slack to be pulled out of straps 111 and 112 to tightly secure the inner end of mat 110 to watercraft 101.

Figure 11:
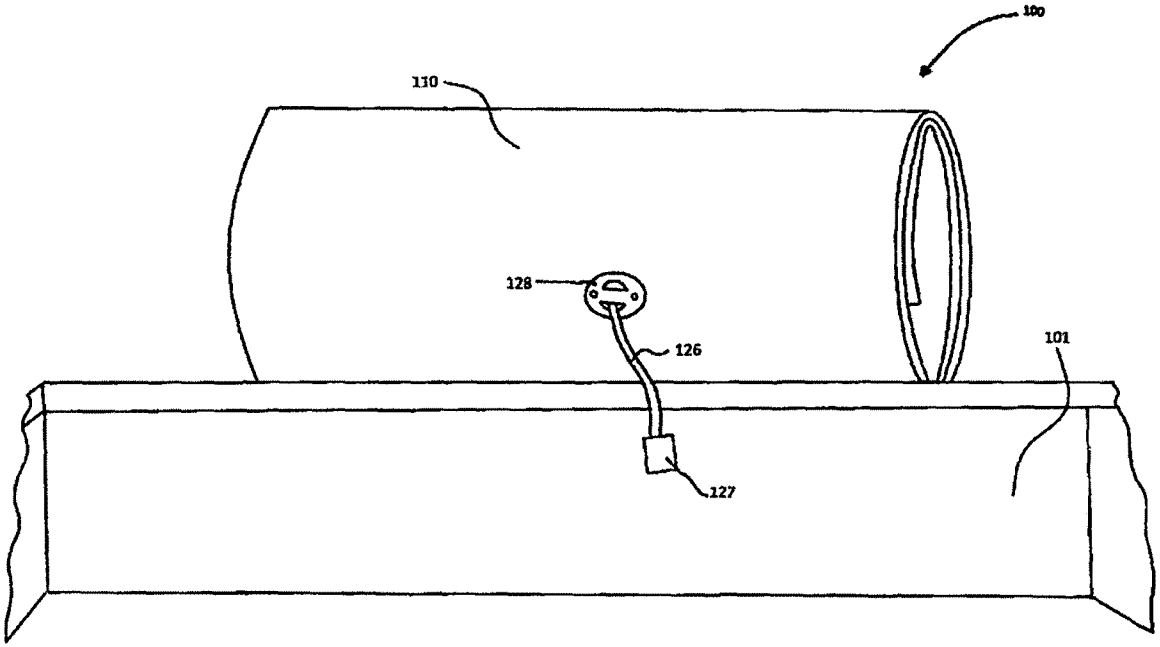
FIG. 11 illustrates an elevated planar view of the rollable mat of FIG. 7 showing the mat in the rolled position and anchored to the watercraft.

A pull up strap 123 attached to the outer end of mat 110 is used to pull the outer end of mat 110 toward watercraft 101 and fold the outer end of mat 110 toward the inner end of mat 110. Pull up strap 123 is secured to a clip 124 located on the back side of mat 110 adjacent the outer end of mat 110. A tie up strap 126 secured to clip 128 located on the back side of mat 110 is used to anchor mat 110 in a rolled position on watercraft 101. Tie up strap 126 is attachable to watercraft structure 127 to hold mat 110 in the rolled position, as seen in FIG. 11. Clips 129 and 131 are located on mat 110 opposite from clips 124 and 128 to facilitate assembly and allow the front and back sides of mat 110 to be interchangeable. Clips 124, 128, 129 and 131 are preferably D-ring clips having flush mount plates fastened to mat 110. Other types of clips and securing members attached to mat 110 can be used to accommodate straps 123 and 126.

Figure 10:
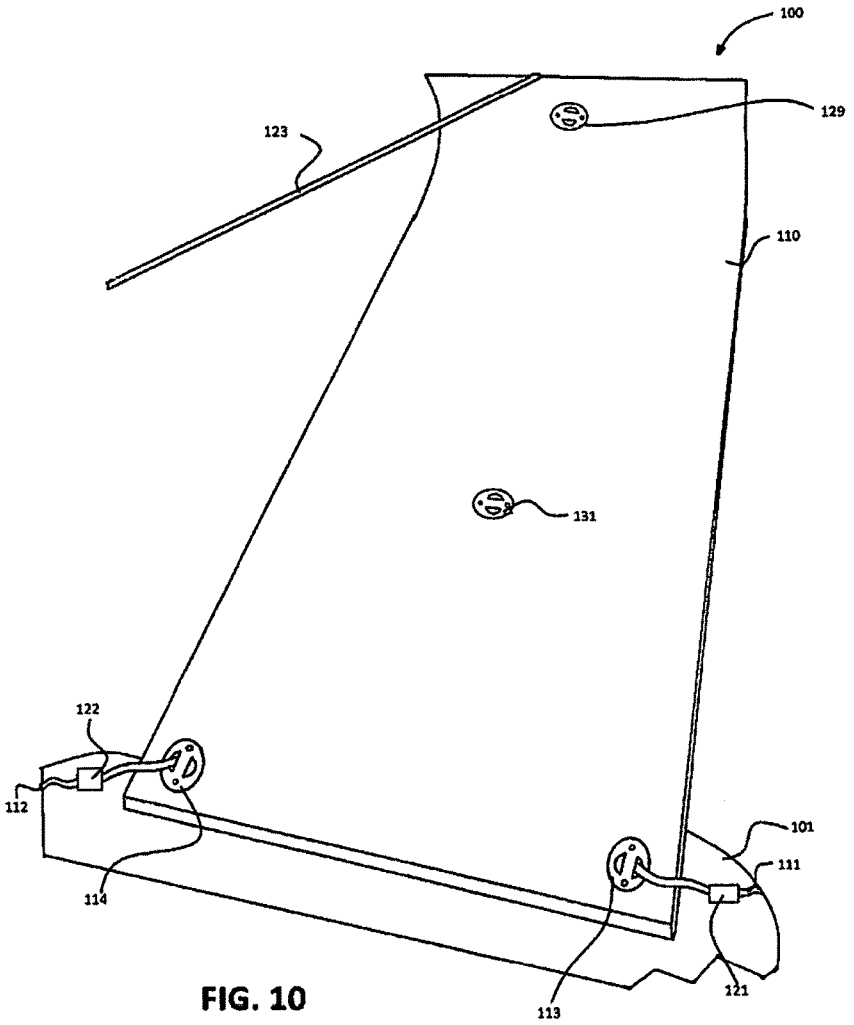
FIG. 10 illustrates an elevated planar view of the rollable mat of FIG. 7 showing the mat being pulled in toward the watercraft from an unrolled position.

In use, hook members 118 and 119 attached to hardware or other structure of watercraft 101 to releasably attached mat 110 to watercraft 101. Slack adjusting members 121 and 122 located on straps 111 and 112 are used to pull out slack from straps 111 and 112 to tightly secure the inner end of mat 110 to watercraft 101. Mat 110 can be moved to an unrolled position and may be used as an anchored flotation water toy and the like. To roll up mat 110, pull up strap 123 attached to the back side of mat 110 adjacent the outer end of mat 110 is used to pull the outer end of mat 110 toward watercraft 101, as seen in FIG. 10. Pulling strap 123 causes the outer end of mat 110 to fold over the center area of mat 110 and then moved adjacent watercraft 101. This allows mat 110 to be moved into the rolled position from within watercraft 101. Upon rolling up mat 110 adjacent watercraft 101, tie up strap 126 attached to clip 128 is secured to watercraft structure 127 to hold mat 110 in the rolled position, as seen in FIG. 11.

Figure 12:
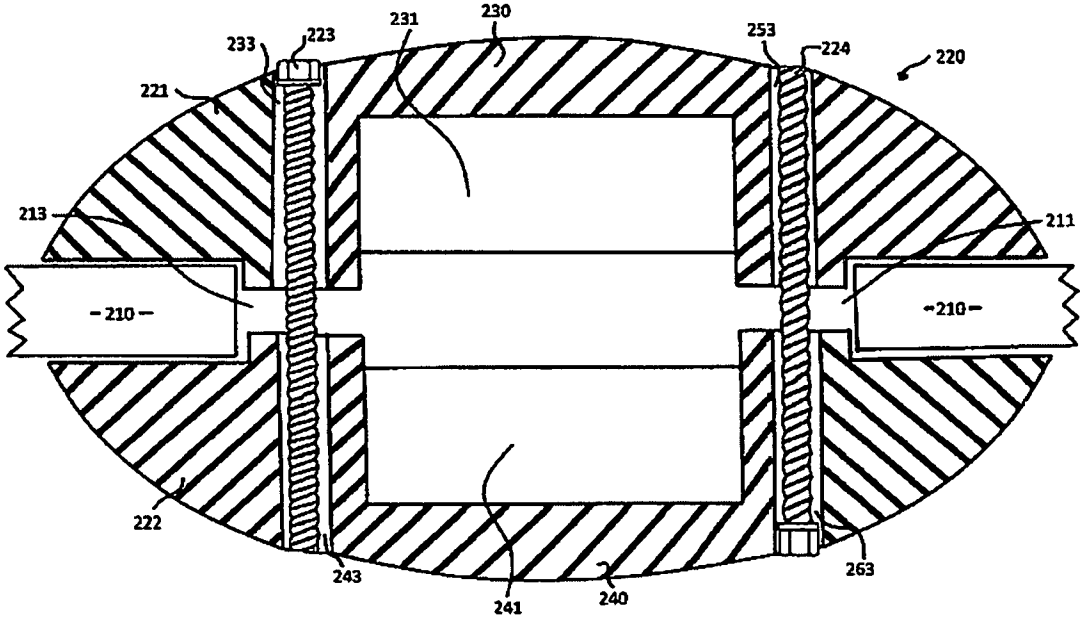
FIG. 12 illustrates a cross section of a preferred embodiment of a securing member of the securing assembly of the rollable mat.

FIG. 12 illustrates a cross section of a preferred embodiment of securing member 220 of the securing assembly to attach mat 210 to straps 111 and 112. Securing member 220 may be used in place of clips 113, 114, 116, 117, 124, 128, 129 and 131, or any other means to attach mat 10, 110 or 210 to straps 111, 112, 123 and 126. In a preferred embodiment, securing member 220 may include cap 221, cap 222, first fastener 223 and second fastener 224. Cap 221 has a curved top surface and is positioned over aperture 211 in mat 210 such that the curved top surface of cap 221 covers aperture 211 and cap 221 extends through mat 210 to come in contact with cap 222 whereby cap 221 may be releasably fixed to cap 222 using fasteners 223 and 224 to provide pressure between cap 221 and cap 222 and releaseably fix securing member 220 to mat 210. Cap 222 has a curved top surface and is positioned over aperture 211 opposite cap 221 such that the curved top surface of cap 222 covers aperture 211. Vertical wall 213 surrounding aperture 211 in mat 210 also provides friction to secure mat 210 to cap 221 and cap 222. In an alternative embodiment, aperture 211 may merely allow fastener 223 to pass through mat 210 and a second aperture would allow fastener 224 to pass through mat 210. In a preferred embodiment, fastener 223 may be a bolt which deforms the walls surrounding bore 233 in cap 221 and corresponding walls surrounding bore 243 using the threading of the bolt to anchor cap 221 and cap 222 to fastener 223. Fastener 224 may also be a bolt which deforms the walls surrounding bore 253 in cap 221 and corresponding walls surrounding bore 263 using the threading of the bolt to anchor cap 221 and cap 222 to fastener 224. Alternatively, fastener 223 and fastener 224 may be a rod, rivet, or other rigid member, and may be made of any material capable of fixing cap 221 in position over cap 222. Cap 221 has a handle 230 to allow strap 111 to loop through opening or passage 231 created under handle 230, or any other manner of attaching strap 111 to cap 221. Strap 111 may alternatively be attached to cap 222, hook member 118, or any other method to attach straps to a mat. Cap 222 has a handle 240 to allow strap 111 to loop through opening or passage 241 created under handle 240.

Figure 13:
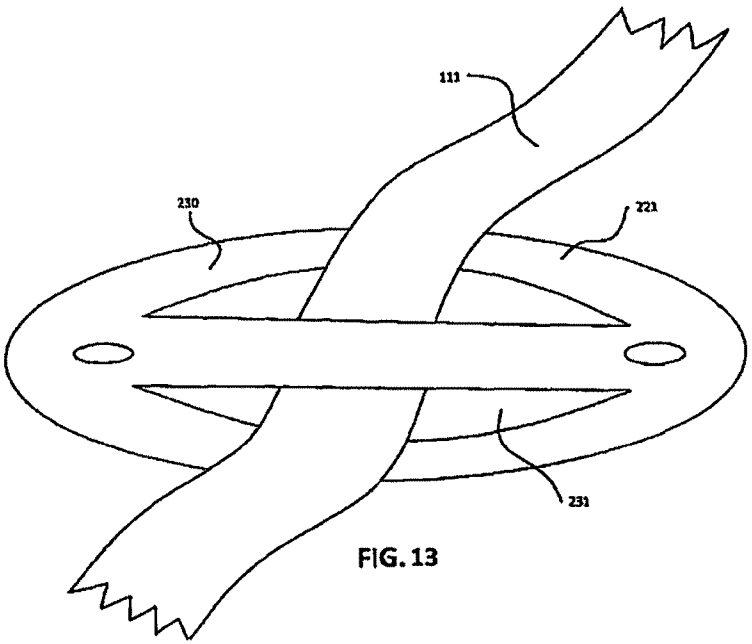
FIG. 13 illustrates an elevated planar view of a securing member of the securing assembly of the rollable mat.

FIG. 13 illustrates an embodiment of securing member 220 showing strap 111 positioned through passage 231 such that strap 111 may form a loop under handle 230.

Figure 14:
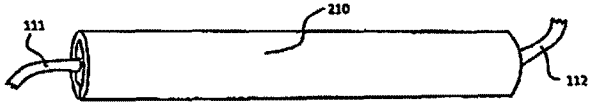
FIG. 14 illustrates an elevated planer view of the rollable mat rolled into a cylindrical shape for storage.

FIG. 14 illustrates an embodiment of the mat where mat 210 is rolled into a cylindrical shape for storage. Straps 111 and 112 protrude from the point at which straps 111 and 112 attach to mat 210 to provide positioning to secure to a vehicle.

The invention may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A rollable mat assembly comprising:

a mat, said mat releasably attached to at least one attachment assembly, said attachment assembly including a sleeve slidably engaged with a center tube such that said sleeve freely rotates about the center tube and winds said mat around said center tube, said sleeve releasably attached to at least one fastener such that said fastener releasably affixes said sleeve to said mat, said center tube slidably engaged to at least one bracket, said center tube including a handle such that said handle facilitates winding said mat around said center tube and at least one protrusion located on the center tube, said bracket including a top surface, bottom surface and a cutout of sufficient size to accommodate said center tube, and sufficient width to support the mat and attachment assembly when attached to a vehicle, said cutout being located a sufficient distance from said bottom surface of said bracket such that when said bracket is mounted on said vehicle, said vehicle does not interfere with winding said mat around said center tube, and a mounting plate releasably affixed to said bracket such that said bracket is rotatable about said mounting plate such that said bracket is positioned flush to said vehicle when said bracket is attached to said vehicle, said mounting plate including a first wall, a second wall, a side wall and a bottom wall, said first wall including a first fastener for rotatably securing said bracket to said mounting plate, said second wall including a second fastener for rotatably securing said bracket to said mounting plate, said side wall being positioned and of sufficient height such that said side wall prevents said bracket from rotating towards said side wall, said bottom wall positioned flush and mounted to the vehicle such that said bottom wall supports the mat and attachment assembly and allows said first wall, said second wall and said side wall to project from said vehicle such that said mounting plate accommodates said bracket.

* * * * *